United States Patent [19]

Johnson

[11] 4,082,356

[45] Apr. 4, 1978

[54] EDUCATIONAL PUZZLE CHAIR

[76] Inventor: Karin Ruth Johnson, 123 Glen Dr., Sausalito, Calif. 94965

[21] Appl. No.: 772,123

[22] Filed: Feb. 25, 1977

[51] Int. Cl.[2] ..... A47C 7/00

[52] U.S. Cl. ..... 297/442; 46/15; 46/17

[58] Field of Search ..... 46/15, 17; 297/442, 297/423

[56] References Cited

U.S. PATENT DOCUMENTS

| | | | |
|---|---|---|---|
| 1,747,900 | 2/1930 | Jenny | 297/442 |
| 2,551,071 | 5/1951 | Tyng | 297/442 X |
| 3,547,491 | 12/1970 | Bovasso | 297/442 |
| 3,788,700 | 1/1974 | Wartes | 297/442 |

*Primary Examiner*—James C. Mitchell
*Attorney, Agent, or Firm*—George W. T. Loo

[57] ABSTRACT

An educational puzzle chair for children between the ages of 18 months and 5 years of age. The chair includes two identical sides, a brace, two identical wedges, a back and a step. The chair is assembled by interlocking its parts in a predetermined manner and order without the use of any fastening elements or tools. All pieces except the sides are reversible. The components of the chair can be stored in a minimum amount of space and can be placed in a small container for easy carrying. The chair is durable and economical to produce.

6 Claims, 3 Drawing Figures

EDUCATIONAL PUZZLE CHAIR

BACKGROUND OF THE INVENTION

1. Field of Invention

My invention relates to a knockdown chair which serves as an educational puzzle for pre-school children between the ages of 18 months and 5 years.

2. Description of the Prior Art

Prior art knockdown furniture, such as Basile (U.S. Pat. No. 2,628,668, dated Feb. 17, 1953), Rumble (U.S. Pat. No. 3,300,245, dated Jan. 24, 1967) and Ferman (U.S. Pat. No. 3,603,656, dated Sept. 7, 1971) are not designed for assembly by a child. My invention is designed for assembly by a very young child as a part of his learning process.

SUMMARY OF THE INVENTION

The invention relates to a knockdown chair which serves as an educational puzzle for pre-school children between the ages of 18 months and 5 years. It is designed for assembly by a very young child as a part of his learning process.

An object of this invention is to provide a knockdown chair which will serve as an educational puzzle for pre-school children.

Another object of this invention is to provide a knockdown chair having interlocking parts which can be put together by a child.

Still another object of this invention is to provide a knockdown chair which can be assembled and disassembled without the use of any fastening elements or tools.

A still another object of this invention is to provide a knockdown chair which is durable and economical to produce.

A further object of this invention is to provide a knockdown chair which can be stored in a minimum amount of space and can be placed in a small container for sale or easy carrying.

Another object of this invention is to provide a knockdown chair which helps to promote the refinement of a child's motor skills and aid the child's comprehensive and conceptual development.

Still another object of this invention is to provide a safe and sturdy knockdown chair.

A still another object of this invention is to provide a knockdown chair that has reversible interlocking parts.

A further object of this invention is to provide a knockdown chair that interlocks when assembled to provide a stable and comfortable chair.

Another object of this invention is to provide a knockdown chair which is simple in construction, inexpensive to manufacture, easy to assemble and disassemble, easy to handle, compact, decorative and very durable.

Other objects, features and advantages of the present invention will be readily apparent from the following detailed description taken in connection with the accompanying drawings.

DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
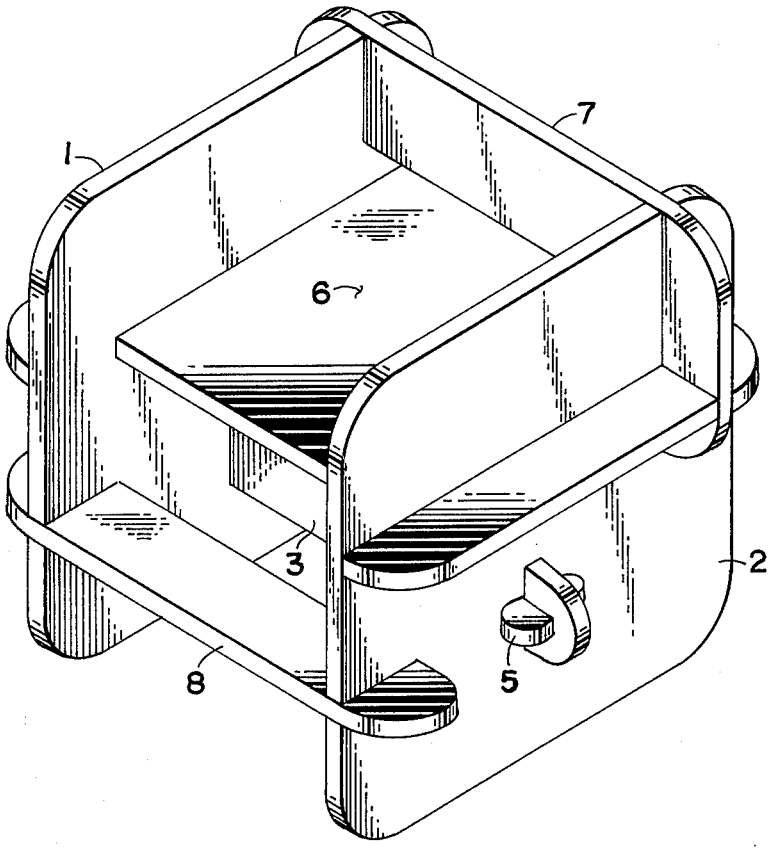
FIG. 1 is a perspective view of the chair.
Figure 2:
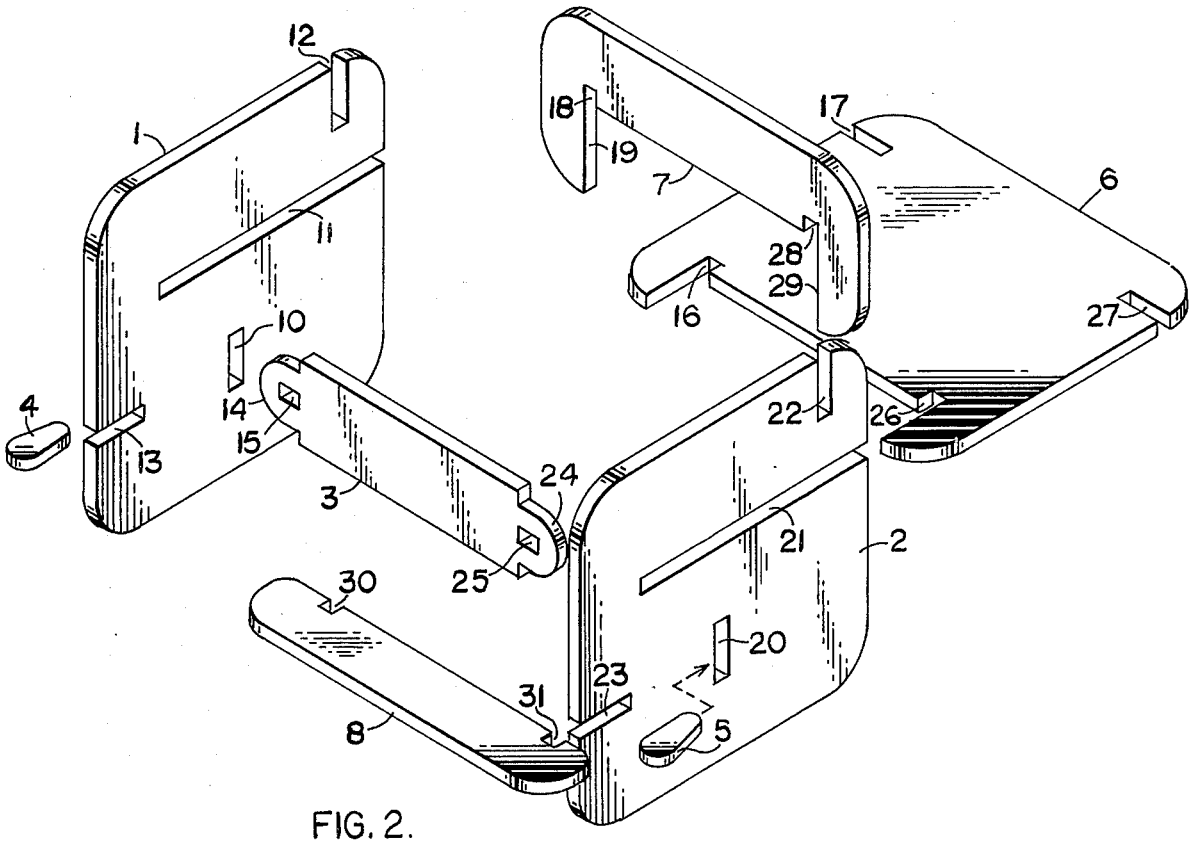
FIG. 2 is an exploded perspective of the chair components in position to be assembled.
Figure 3:
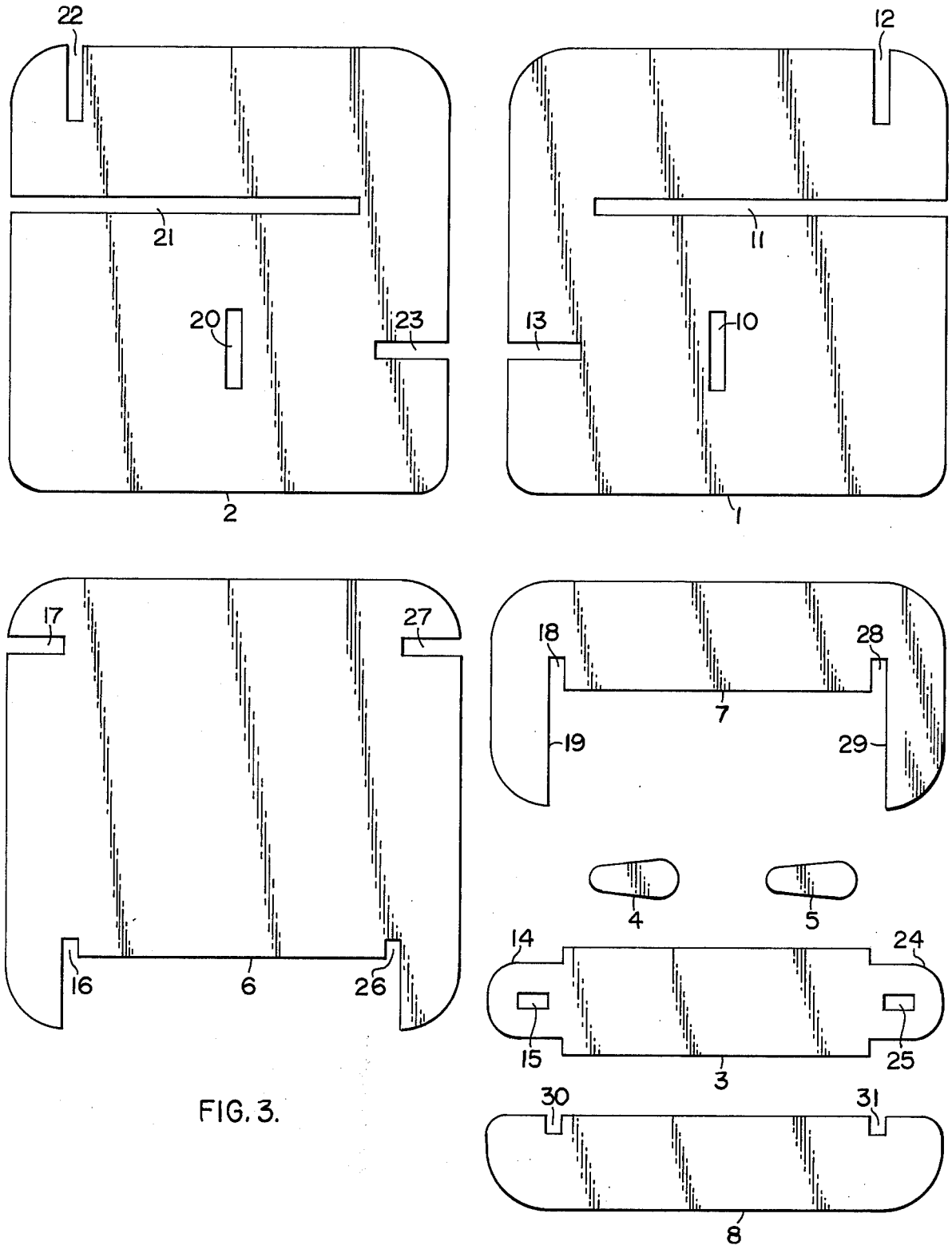
FIG. 3 is a layout of all the parts of the chair combination.

Referring now to the drawings wherein like reference numerals refer to like and corresponding parts throughout the several views, the preferred embodiment of the invention disclosed in FIGS. 1 to 3 inclusive, includes a pair of sides 1 and 2, brace 3, a pair of wedges 4 and 5, seat 6, back 7 and step 8. Sides 1 and 2 are identical to each other; wedges 4 and 5 are identical to each other.

Sides 1 and 2 are two identical squares with rounded corners and four slots. Side 1 has a vertical slot 10, a long horizontal slot 11, a top vertical slot 12 and a short horizontal slot 13. Side 2 has similar slots numbered 20, 21, 22 and 23, respectively. Slot 10 is adapted to interlock with tongue 14 on brace 3. Slot 11 is adapted to interlock with slot 16 on seat 6. Slot 12 is adapted to interlock with slot 18 on back 7. Slot 13 is adapted to interlock with slot 30 on step 8. Slots 20, 21, 22 and 23 of side 2 are adapted to interlock, respectively, with tongue 24, slot 26, slot 28 and slot 31. See FIGS. 1 and 2.

Brace 3 is a rectangle with rounded tongues 14 and 24. Slots 15 and 25 are located within tongues 14 and 24, respectively.

Wedges 4 and 5 are tapered. They may have a straight side and a slanted side in lieu of tapered sides, if it is deemed to be desirable. Wedge 4 is adapted to fit within slot 15 of tongue 14. Wedge 5 is adapted to fit within slot 25 of tongue 24. See FIGS. 1 and 2.

Seat 6 is a rectangle with two forward bifurcated arms on its front edge. Seat 6 has vertical slots 16 and 26 and horizontal slots 17 and 27. Slots 16 and 26 are adapted to, respectively, interlock with slots 11 and 21 of sides 1 and 2. See FIG. 2.

Back 7 is a rectangle with two fingers 19 and 29. Back 7 has vertical slots 18 and 28. Slots 18 and 28 are adapted to, respectively, interlock with slots 12 and 22 of sides 1 and 2. See Fig. 2.

Step 8 is a rectangle with rounded edges along its front edge and vertical slots 30 and 31 on its back edge. Slots 30 and 31 are adapted to, respectively, interlock with slots 13 and 23 of sides 1 and 2. See FIG. 2.

The width of the slots equal the thickness of the material used to make the chair for a snug fit.

To assemble my invention: (1) Insert tongue 14 of brace 3 through slot 10 of side 1. (2) Secure brace 3 to side 1 by placing wedge 4 into slot 15. (3) Insert tongue 24 through slot 20 of side 2. (4) Secure brace 3 to side 2 by playing wedge 5 into slot 25. (5) Insert seat 6 into slots 11 and 21 of sides 1 and 2 so that slot 16 is received by side 1 and slot 26 is received by side 2. (6) Insert back 7 as that slot 18 is received by slot 12 of side 1 and slot 28 is received by slot 22 of side 2 and so that finger 19 is received by slot 17 and finger 29 is received by slot 27. (7) Insert step 8 so that slot 30 is received by slot 13 and slot 31 is received by slot 23.

When assembled, the seating area of my knockdown chair is: Width 11 inches, Depth 10 inches and Height 10 inches. These dimensions, incidentally, conform with standards of *Architectural Graphic Standards* for children in the 18 months to 5 years age group.

The various parts of the chair are so fabricated that they provide their own fastening elements. All of the parts fit firmly together as the various slots in the several parts are only of sufficient width to snugly accomodate their counterpart members adapted to be inserted therein. By using such an interlocking arrangement for joining the several members together, each member serves to reinforce the adjacent or interlocked member and thus a strong and sturdy chair is provided without the use of external fastening elements such as nails, screws, clamps, etc.

The interlocking joint design makes assembly and disassembly of the chair without tools so simple that a child can do it. Also, because of the interlocking arrangements for joining the several members together and the resulting strength and rigidity of the chair, it is practical to use plywood having a thickness of ⅜ inch or greater. In my preferred embodiment, I have used plywood of ½ inch thickness.

My invention is inexpensive to manufacture. It is capable of being produced by mass production methods. Similar parts of the chair are interchangeable as no custom fitting is required. The components of the chair may be constructed from rigid flat material such as ½ inch thick plywood panels. If desired, it can be made of ⅜ inch thick plywood because the interlocking parts give the chair strength and rigidity. Nine chairs can be made from two 4feet by 8feet sheets of plywood. It may also be made of injection molded high density polyethylene by use of a die. In addition, it may be made of plexiglas or with a combination of plexiglas and wood. Any strong, durable and relatively light material may be used to make my invention.

My invention is decorative. It has a pleasing appearance. Since the two sides are interchangeable and all other pieces are reversible, it is possible to alter the appearance of the assembled chair by using pieces with a different color on each side and by assembling the pieces in a different manner.

My invention is compact. The parts are flat and narrow. In its disassembled condition it can be stored in a minimum amount of space, 16 inches by 15 inches by 2 inches, and can be placed or packed within a small container for sale or for easy carrying. Transportation costs are less because less space in transporting it is needed and because it is light in weight.

My invention is very durable. It is designed to withstand the rough usage of children. The parts were purposely made sturdy and easy to maintain.

My invention is safe for children. The corners of the parts of my chair have been rounded to minimize the possibility of injury. Legs have been eliminated to create a more structurally sound and stable chair. The sides of the chair cover more floor area than would conventional four legged designs. My chair will not tip over when an adult stands on its step. It will remain intact and stable when an adult stands on its seat. It will not fall apart or lose its stability with the removal of the step or wedges. It cannot be accidentally disassembled. The parts of the chair are not large enough to cause injury to a child.

During the first five years of the life of a child, fundamental motor patterns emerge as he manipulates various objects encountered in his environment. It is a time when the development of motor skill goes from gross to specific refinement, coupled with a progressive broadening of the child's comprehension and conceptualization of the world around him. My invention helps to promote the refinement of motor skills and aids in the child's comprehensive and conceptual development.

My invention has been successfully tested with preschool children between 18 months and 5 years of age. The optimum use of my invention depends on a child's age, state of development, physical strength and comprehension. A normal child of 5 years of age can assemble and disassemble my invention. My 5 year old child has assembled and disassembled my invention by herself in 6 minutes. A normal 4 year old child can, with initial adult instruction, learn to assemble and disassemble my invention within a relatively short period of time. Younger children below 4 years of age may not be able to successfully manipulate the three large pieces, 2 sides and 1 seat, by themselves. An 18 month old child may use my invention as a climbing and sitting area and may not comprehend its use as an educational puzzle. However, the fact that younger children, 18 months to 4 years of age, may not be able to fully use my invention does not negate from its educational value.

A child will benefit from its use in proportion to the amount of use he is capable of giving it. For example, an 18 month old child will use my invention as a climbing and sitting area. He is able to remove and replace the step and the wedges, after much experimentation. He learns to use the step as a means of climbing onto the seat and, once seated, to use the step as a resting place for his feet. His continual attempt to replace the step aids his eye/hand coordination as the step has two slots which must be matched up with the horizontal slots on the lower frontal edge of each side. He learns through trial and error the correct way to insert the wedges. The insertion of the wedges in the slots aids his fine muscle control as the wedges and the point of placement are relatively small.

A 1½ to 2½ year old child can easily remove and replace the step and wedges, but he will find the replacement of the back too dificult. A child of 2½ to 3½ years of age may have difficulty replacing the back, but should be able with practice to do so. A child of 3½ to 5 years of age can assemble the back with relative ease. Manipulation of the three larger pieces, the seat and the two sides, can be successfully manipulated by children between 4 and 5 years of age as the pieces are a good deal larger than the step and wedges. The brace, while smaller, must be manipulated in conjunction with the sides. The 8 component parts of my invention must be assembled in a particular sequence.

Imagination and creative thought are at play in regards to each child's personal use of his chair. My invention is a wholesome and self-enhancing product as a child is positively reinforced when he successfully assembles the pieces he is capable of assembling.

Aside from its educational value, my invention may be used as a chair. It is more stable than a chair with four legs. It has pleasing appearance. It allows more freedom of movement of the torso and upper limbs as the height of the back is equal to that of its sides and comes somewhere between the lower thoracic vertabrae and the lumbar vertebrae, whereas conventional chairs may have backs as high as the cervical vertabrae which restricts movement to the front and sides of the chair. It is inexpensive to manufacture, easy to assemble and manipulate, compact and very durable in use.

Although but a single embodiment of the invention has been disclosed and described herein, it is obvious that many changes may be made in the size, shape, arrangements and details of the various elements of the invention without departing from the scope of the novel concepts of the present invention.

I claim as my invention:

1. An educational puzzle chair, comprising the combination of two substantially square sides, a brace, two wedges, a seat, a back, and a step; the sides each have rounded corners and four slots, a lower vertical slot, a long horizontal slot, an upper vertical slot, and a short horizontal slot; the lower vertical slot is adapted to interlockingly engage one end of the brace, the long horizontal slot is adapted to interlockingly engage a vertical slot of the seat, the upper vertical slot is adapted to interlockingly engage a vertical slot of the back, and the short horizontal slot is adapted to interlockingly engage a vertical slot of the step; the wedges are adapted to interlockingly engage in two slots of the brace; all of the components are of such a size that they can be handled by pre-school children.

2. The educational puzzle chair of claim 1, wherein the brace is a rectangle with rounded slotted tongues on its ends and the wedges are adapted to fit within said slotted tongues.

3. The knockdown chair of claim 2, wherein the seat is a rectangle with forward projecting bifurcated arms on its front edge, two vertical slots are located adjacent to the front edge and arms of the seat.

4. The knockdown chair of claim 3, wherein the back is a rectangle with two spaced fingers, two vertical slots are located adjacent to the front edge and fingers of the back.

5. The knockdown chair of claim 4, wherein the step is a rectangle with rounded edges on one edge and two spaced vertical slots on the other edge.

6. The educational puzzle chair of claim 5, wherein the seating area is of a size that will comfortably seat a pre-school child.

* * * * *